US007363861B2

(12) United States Patent
Brune et al.

(10) Patent No.: US 7,363,861 B2
(45) Date of Patent: Apr. 29, 2008

(54) PYROTECHNIC SYSTEMS AND ASSOCIATED METHODS

(75) Inventors: Neal W. Brune, La Quinta, CA (US); Andrew R. Dawson, Indio, CA (US); George H. Wessels, Pflugerville, TX (US); Kevin M. Ford, Austin, TX (US)

(73) Assignee: Armtec Defense Products Co., Coachella, CA (US)

( * ) Notice: Subject to any disclaimer, the term of this patent is extended or adjusted under 35 U.S.C. 154(b) by 432 days.

(21) Appl. No.: 10/918,543

(22) Filed: Aug. 13, 2004

(65) Prior Publication Data

US 2006/0032391 A1 Feb. 16, 2006

(51) Int. Cl.
*F42B 4/26* (2006.01)

(52) U.S. Cl. ..... 102/342; 102/341; 102/336

(58) Field of Classification Search ..... 102/342, 102/341, 335, 336, 357, 379, 380, 202.1, 102/256, 258, 259; 89/1.55, 1.812, 1.14, 89/6.5

See application file for complete search history.

(56) References Cited

U.S. PATENT DOCUMENTS

| | | | |
|---|---|---|---|
| 260,153 | A | 6/1882 | Bennett |
| 2,072,671 | A | 3/1937 | Foulke |
| 2,322,624 | A | 6/1943 | Forbes |
| 2,346,792 | A | 4/1944 | Rush |
| 2,383,053 | A | 8/1945 | Fanger et al. |

(Continued)

FOREIGN PATENT DOCUMENTS

| | | | |
|---|---|---|---|
| DE | 2705235 | | 8/1978 |
| EP | 463904 | A1 | 1/1992 |
| EP | 0483787 | | 5/1992 |
| EP | 0307307 | B1 | 7/1992 |
| FR | 2385075 | | 10/1978 |

(Continued)

OTHER PUBLICATIONS

International Search Report dated Mar. 28, 2003 for PCT Application PCT/US/02/33906.

(Continued)

*Primary Examiner*—Michelle Clement
(74) *Attorney, Agent, or Firm*—Perkins Coie LLP

(57) ABSTRACT

Pyrotechnic systems and associated methods are disclosed. In one embodiment, a pyrotechnic system includes a combustible material in a housing having a first and second portion. The first portion of the housing can have an inlet for receiving combustion products and the second portion can have an outlet to propagate combustion between the second portion of the housing and the combustible material. The system can further include a combustible carrier material movable from the first portion of the housing to the second portion of the housing. The combustible carrier material can be ignited in a first portion of the housing and capable of sustaining combustion while being moved to the second portion of the housing. Additional embodiments can include a seal positioned to block a migration of combustion products between the first and second portions of the housing when the combustible carrier material is in the first portion of the housing. Still further embodiments can include a vent system located proximate to the first portion of the housing and the inlet wherein the vent system includes a passageway to allow combustion products to migrate away from the first portion of the housing and/or the inlet. In yet a further embodiment, the system can include at least one gasket positioned proximate to the outlet to prevent the migration of combustion products to the combustible material except from the outlet.

32 Claims, 6 Drawing Sheets

U.S. PATENT DOCUMENTS

| | | | | |
|---|---|---|---|---|
| 2,489,337 | A | | 11/1949 | Sperling |
| 2,775,943 | A | | 1/1957 | Ekserzian |
| 2,824,755 | A | | 2/1958 | Lamphear |
| 2,862,446 | A | | 12/1958 | Ringdal |
| 2,866,412 | A | | 12/1958 | Meyer et al. |
| 2,996,988 | A | | 8/1961 | Kunz |
| 3,077,330 | A | | 2/1963 | Lamphear |
| 3,127,148 | A | | 3/1964 | Collar |
| 3,160,099 | A | | 12/1964 | Nooker |
| 3,194,161 | A | | 7/1965 | Becker et al. |
| 3,224,371 | A | | 12/1965 | Kempton et al. |
| 3,224,372 | A | | 12/1965 | Nooker |
| 3,249,050 | A | | 5/1966 | Cordle et al. |
| 3,320,888 | A | | 5/1967 | Churchill |
| 3,434,422 | A | | 3/1969 | Herman et al. |
| 3,490,374 | A | | 1/1970 | Nooker |
| 3,561,725 | A | | 2/1971 | Torres |
| 3,605,624 | A | | 9/1971 | Dinsdale et al. |
| 3,609,115 | A | | 9/1971 | Sammons et al. |
| 3,662,802 | A | | 5/1972 | Bedell |
| 3,680,483 | A | | 8/1972 | Staudacher et al. |
| 3,690,257 | A | | 9/1972 | Nooker et al. |
| 3,696,750 | A | | 10/1972 | Colgate et al. |
| 3,696,751 | A | | 10/1972 | Kempton |
| 3,705,549 | A | | 12/1972 | Quinlan et al. |
| 3,713,390 | A | | 1/1973 | Pieper |
| 3,720,168 | A | | 3/1973 | Sylwester |
| 3,742,856 | A | | 7/1973 | Welanetz |
| 3,745,927 | A | | 7/1973 | Tanner et al. |
| 3,791,303 | A | | 2/1974 | Sweeney et al. |
| 3,808,973 | A | | 5/1974 | Galluzzi |
| 3,853,645 | A | | 12/1974 | Kaufman et al. |
| 3,863,254 | A | | 1/1975 | Turner |
| 3,878,396 | A | | 4/1975 | Vallet |
| 3,885,727 | A | | 5/1975 | Gilley |
| 3,894,679 | A | | 7/1975 | Reifers et al. |
| 3,895,578 | A | | 7/1975 | Shaw et al. |
| 3,901,153 | A | | 8/1975 | Brabets et al. |
| 3,910,189 | A | | 10/1975 | Whidden et al. |
| 3,911,824 | A | | 10/1975 | Barr et al. |
| 3,938,441 | A | | 2/1976 | Sewell et al. |
| 3,955,506 | A | | 5/1976 | Luther et al. |
| 3,986,655 | A | | 10/1976 | Rynning |
| 4,015,527 | A | | 4/1977 | Evans |
| 4,036,103 | A | | 7/1977 | Gawlick et al. |
| 4,069,762 | A | | 1/1978 | Maury |
| 4,077,326 | A | | 3/1978 | Funk et al. |
| 4,098,625 | A | | 7/1978 | French et al. |
| 4,196,129 | A | | 4/1980 | Rhein et al. |
| 4,197,801 | A | | 4/1980 | LaFever et al. |
| 4,220,089 | A | | 9/1980 | Smith |
| 4,276,100 | A | | 6/1981 | Colvin et al. |
| 4,289,295 | A | | 9/1981 | Allread |
| 4,335,657 | A | | 6/1982 | Bains |
| 4,392,432 | A | | 7/1983 | Fenrick et al. |
| 4,404,912 | A | | 9/1983 | Sindermann |
| 4,434,718 | A | | 3/1984 | Kopsch et al. |
| 4,435,481 | A | | 3/1984 | Baldi |
| 4,444,115 | A | | 4/1984 | Romer et al. |
| 4,446,793 | A | | 5/1984 | Gibbs |
| 4,459,915 | A | | 7/1984 | Lynch |
| 4,505,203 | A | | 3/1985 | Brady et al. |
| 4,535,697 | A | | 8/1985 | Moser et al. |
| 4,593,622 | A | | 6/1986 | Fibranz |
| 4,604,954 | A | | 8/1986 | Clarke et al. |
| 4,640,195 | A | | 2/1987 | Campoli |
| 4,739,708 | A | | 4/1988 | Halpin et al. |
| 4,763,577 | A | | 8/1988 | Romer et al. |
| 4,768,439 | A | | 9/1988 | Singer et al. |
| 4,802,415 | A | | 2/1989 | Clarke et al. |
| 4,815,390 | A | | 3/1989 | Garcia |
| 4,863,534 | A | | 9/1989 | Forsberg |
| 4,867,036 | A | | 9/1989 | Haskins |
| 4,881,464 | A | | 11/1989 | Sayles |
| 4,907,510 | A | | 3/1990 | Martwick et al. |
| 4,941,244 | A | | 7/1990 | Ortmann et al. |
| 5,029,530 | A | | 7/1991 | Martwick et al. |
| 5,042,388 | A | | 8/1991 | Warren et al. |
| 5,090,323 | A | | 2/1992 | Kallevig et al. |
| 5,121,692 | A | | 6/1992 | DiCarlo |
| 5,136,950 | A | | 8/1992 | Halpin et al. |
| 5,138,949 | A | | 8/1992 | Swartout et al. |
| 5,155,295 | A | | 10/1992 | Campoli |
| 5,160,804 | A | | 11/1992 | Wahner et al. |
| 5,233,928 | A | | 8/1993 | Ducros et al. |
| 5,265,540 | A | | 11/1993 | Ducros et al. |
| 5,317,163 | A | | 5/1994 | Obkircher |
| 5,333,551 | A | | 8/1994 | Heitmann et al. |
| 5,343,794 | A | | 9/1994 | Andreotti et al. |
| H1367 | H | | 11/1994 | Allen, Jr. et al. |
| 5,361,700 | A | | 11/1994 | Carbone |
| 5,388,522 | A | | 2/1995 | Martwick et al. |
| 5,415,104 | A | | 5/1995 | Bispling et al. |
| 5,423,262 | A | | 6/1995 | Pettersson et al. |
| 5,433,148 | A | | 7/1995 | Barratault et al. |
| 5,456,455 | A | | 10/1995 | Dillehay et al. |
| 5,467,716 | A | | 11/1995 | Boual |
| 5,524,546 | A | | 6/1996 | Rozner et al. |
| 5,526,751 | A | * | 6/1996 | Spivey et al. ..... 102/341 |
| 5,531,163 | A | | 7/1996 | Dillehay et al. |
| 5,557,059 | A | | 9/1996 | Warren et al. |
| 5,561,260 | A | | 10/1996 | Towning et al. |
| 5,563,365 | A | | 10/1996 | Dineen et al. |
| H1603 | H | * | 11/1996 | Deckard et al. ..... 102/336 |
| 5,631,441 | A | | 5/1997 | Briere et al. |
| 5,639,984 | A | | 6/1997 | Nielson |
| 5,661,257 | A | | 8/1997 | Nielson et al. |
| 5,679,921 | A | | 10/1997 | Hahn et al. |
| 5,841,062 | A | | 11/1998 | Manole et al. |
| 5,912,430 | A | | 6/1999 | Nielson |
| 6,013,144 | A | | 1/2000 | Callaway |
| 6,119,600 | A | | 9/2000 | Burri |
| 6,158,348 | A | | 12/2000 | Campoli |
| 6,284,990 | B1 | | 9/2001 | Arnold |
| 6,311,622 | B1 | | 11/2001 | Adimari |
| 6,389,976 | B1 | | 5/2002 | Zacharin |
| H2039 | H | | 8/2002 | Holt et al. |
| 6,427,599 | B1 | * | 8/2002 | Posson et al. ..... 102/336 |
| 6,450,099 | B1 | | 9/2002 | Desgland |
| 6,457,603 | B1 | | 10/2002 | Freist et al. |
| 6,460,460 | B1 | | 10/2002 | Jasper, Jr. et al. |
| 2002/0088367 | A1 | | 7/2002 | Mac Aleese et al. |

FOREIGN PATENT DOCUMENTS

| | | | |
|---|---|---|---|
| FR | 2702554 | A1 | 9/1994 |
| GB | 732633 | | 6/1955 |
| GB | 2044416 | | 10/1980 |
| GB | 2266944 | A | 11/1993 |
| WO | WO-94/20813 | A1 | 9/1994 |
| WO | WO-94/20814 | A1 | 9/1994 |
| WO | WO-99/24778 | | 5/1999 |

OTHER PUBLICATIONS

International Search Report for International Application No. PCT/US02/38033, Armtec Defense Products Co., Dec. 4, 2003 (2 pages).

Tim Thompson, Dipak Kamdar, "Computer Modeling of Pressures on 120mm Tank Round in the M256 Gun" presented at the National Defense Industrial Association 36th Annual Gun & Ammunition Symposium & Exhibition, Apr. 10, 2001, Alliant Techsystems.

* cited by examiner

PYROTECHNIC SYSTEMS AND ASSOCIATED METHODS

TECHNICAL FIELD

The following disclosure relates generally to pyrotechnic systems and associated methods, for example, aircraft decoy flare systems with safe and ignite mechanisms.

BACKGROUND

Modern aircraft often use decoy flares to defeat infrared-guided weapons. Typically, decoy flares are deployed in flight by ejecting the flare from a tube and then igniting the flare, which emits electromagnetic radiation. The infrared-guided weapon can lock on and track the decoy flare and/or the heat source of the aircraft can be masked by the flare, providing the aircraft with an opportunity to elude the weapon.

FIG. 1 is a partially schematic cut-away view of a conventional flare 1 and a deployment tube 2 illustrating a system for igniting the flare 1, in accordance with the prior art. In FIG. 1, a bore rider system 4 is used to ignite the flare 1 after the flare 1 leaves the deployment tube 2. The bore rider system 4 has a compartment 10 attached to the flare grain 62. The compartment 10 has a first section 10*a* and second section 10*b*. The first section 10*a* has a first opening 12 and the second section 10*b* has a second opening 11. A flammable material 20 is coupled to a bore rider 50 that has a depressed position and an extended position. As long as the flare 1 is in the deployment tube 2, the bore rider 50 remains in the depressed position and the flammable material 20 remains in the first section 10*a* of the compartment 10.

When an expulsion charge 5 is fired, hot expanding gases propel the flare 1 out of the deployment tube 2 and penetrate the first section 10*a* of the housing 10, igniting the flammable material 20. As the flare 1 leaves the deployment tube 2 (shown by phantom lines), the bore rider is no longer held in the depressed position and a spring 55 moves the flammable material 20 from the first section 10*a* of the compartment 10 to the second section 10*b*. In the second section 10*b*, the flammable material 20 ignites the flare grain, which burns and emits electromagnetic radiation.

A problem with conventional decoy flares is that they can ignite prematurely and/or malfunction so that the flare grain ignites and burns in the deployment tube. For example, combustion can prematurely migrate from the first section of the compartment to the second section and ignite the flare grain before the flare leaves the deployment tube. Additionally, if the flammable material in the compartment ignites before deployment of the flare is commanded, it can cause the flare grain to ignite and burn while the flare is in the deployment tube. Because the deployment tube is not intended to house a burning flare, these conditions can be hazardous to both the aircraft and associated personnel.

SUMMARY

The present disclosure is directed toward pyrotechnic systems and associated methods. One aspect of the invention is directed toward a pyrotechnic system that includes a package having a combustible material with an aperture proximate to the combustible material. The system further includes a housing having a first portion and a second portion. The first portion has an inlet for receiving combustion products and the second portion has an outlet that is in communication with the aperture to propagate combustion between the second portion of the housing and a combustible material in the package. The system further includes a combustible carrier material movable from the first portion of the housing to the second portion of the housing. The combustible carrier material is ignitable in the first portion of the housing and capable of sustaining combustion while being moved to the second portion of the housing. In a further aspect of the invention, the system can further include a seal positioned to block a migration of combustion products between the first and second portion of the housing when the combustible carrier material is in the first portion of the housing. In another aspect of the invention, the system can further include at least one gasket proximate to the outlet and the aperture to prevent the migration of combustion products through the aperture except from the outlet. In still another aspect of the invention, the system can further include a vent system being located proximate to the first portion of the housing and the inlet. The vent system includes a passageway to allow combustion products to migrate away from the first portion of the housing and/or the inlet.

Another aspect of the invention is directed toward a method for making a pyrotechnic system that includes providing a package having a combustible material with an aperture proximate to the combustible material. The method includes coupling a housing to the package, wherein the housing has a first and a second portion. The first portion has an inlet for receiving combustion products and the second portion has an outlet. The outlet is in communication with the aperture to propagate combustion between the second portion of the housing and the combustible material in the package. The method further includes installing a combustible carrier material that is movable from the first portion of the housing to the second portion of the housing. The combustible carrier material is ignitable in the first portion of the housing and capable of sustaining combustion while being moved to the second portion of the housing. In a further aspect of the invention, the method can include positioning a seal to block a migration of combustion products between the first and second portions of the housing when the combustible carrier material is in the first portion of the housing. In another aspect of the invention, the method can further include positioning at least one gasket proximate to the outlet and the aperture to prevent the migration of combustion products through the aperture except from the outlet. In still another aspect of the invention, the method can further include locating a vent system proximate to the first portion of the housing and the inlet. The vent system includes a passageway to allow combustion products to migrate away from the first portion of the housing and/or the inlet.

DETAILED DESCRIPTION

The present disclosure is directed toward pyrotechnic systems and associated methods, for example, aircraft decoy flare systems having safe and ignite mechanisms. Several specific embodiments are set forth in the following description and in FIGS. 2A-5 to provide a thorough understanding of certain embodiments of the invention. One skilled in the art, however, will understand that the present invention may have additional embodiments, and other embodiments of the invention may be practiced without several of the specific features explained in the following description.

Figure 1:
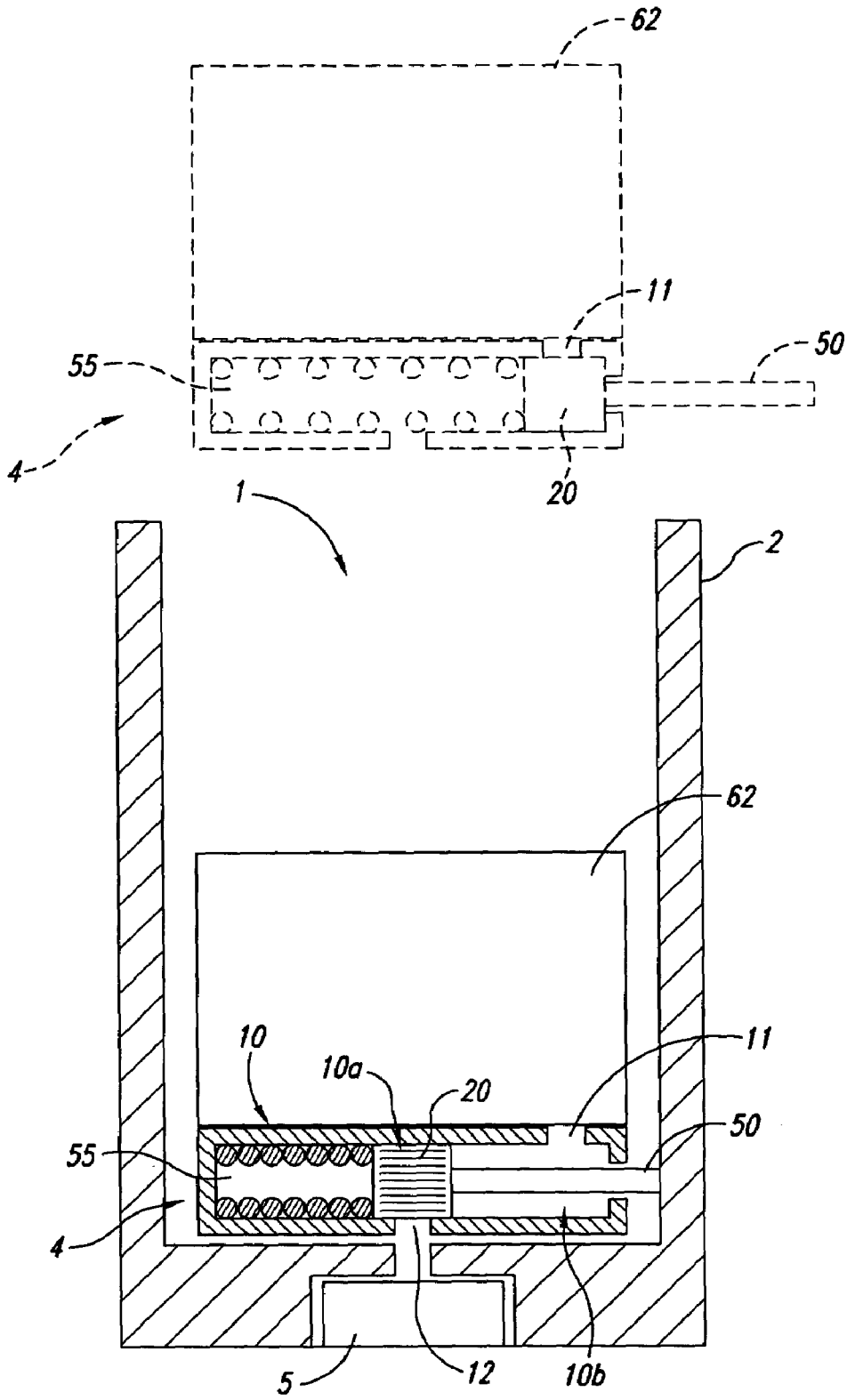
Fig. 1 (Prior Art)
FIG. 1 is a partially schematic cut-away view of a conventional flare and a deployment tube illustrating a method for igniting the flare, in accordance with the prior art.
Figure 2B:
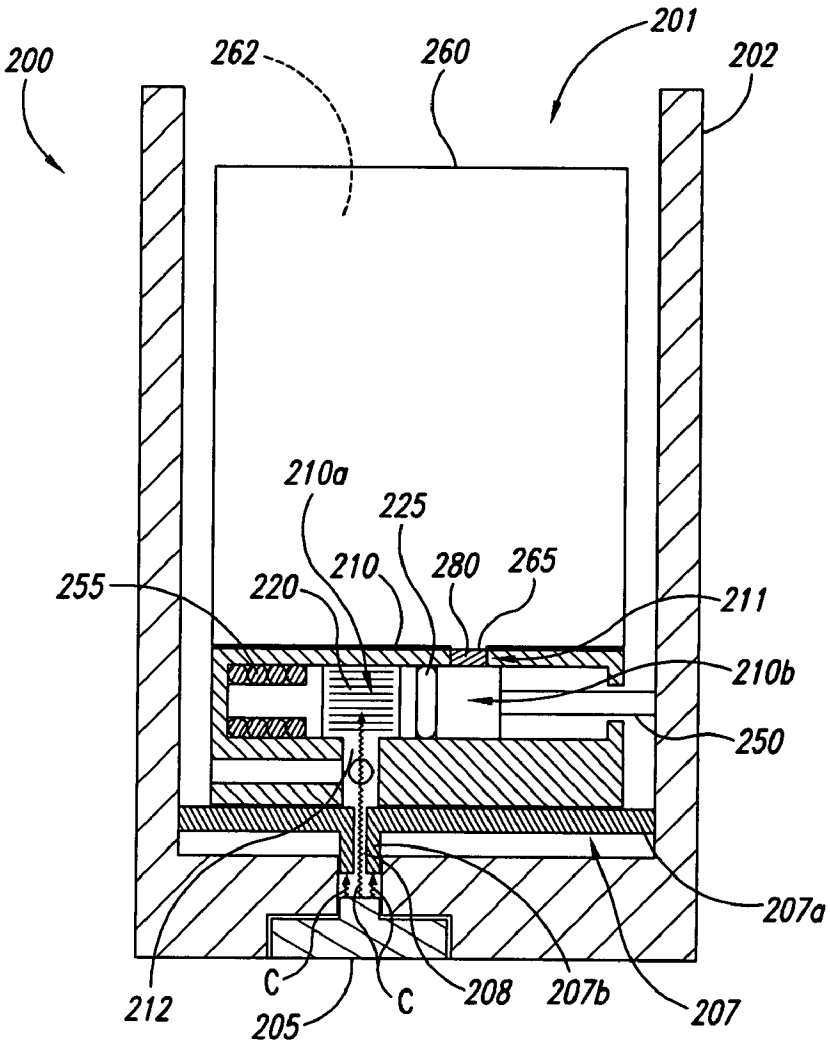
FIG. 2B is a partially schematic cut-away view of the pyrotechnic system shown in FIG. 2A where an expulsion charge has begun to deploy the deployable component.
Figure 2A:
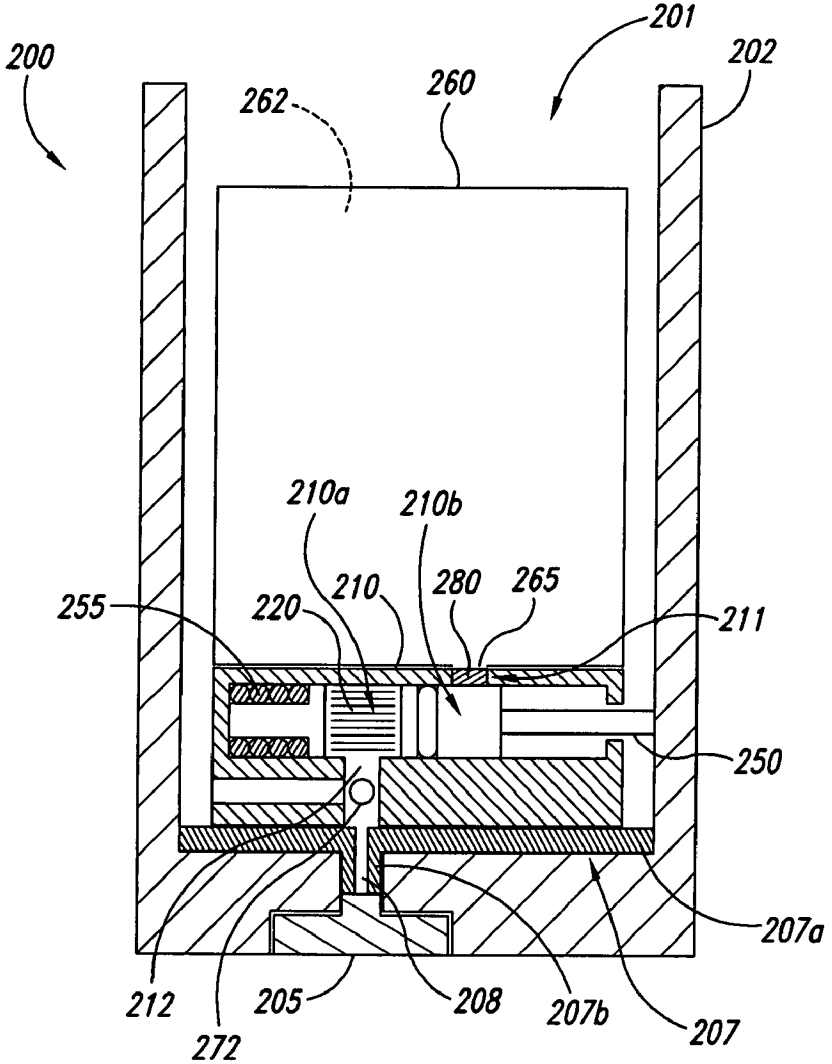
FIG. 2A is a partially schematic cut-away view of a pyrotechnic system with a deployable component positioned in a launcher, in accordance with an embodiment of the invention.

FIG. 2A is a partially schematic cut-away view of a pyrotechnic system 200 with a deployable component 201 positioned in a launcher 202, in accordance with an embodiment of the invention. The deployable component 201 includes a package 260 and a housing 210. The package 260 has a combustible material 262 and an aperture 265 proximate to the combustible material 262. The pyrotechnic system 200 includes at least one feature that ignites the combustible material 262 once the deployable component 201 is clear of the launcher, and several other features that, singularly or in combination, can prevent premature ignition of the combustible material 262. These features, which are described in detail below with reference to FIGS. 2A-5, can provide an effective 'safe and ignite' mechanism for the pyrotechnic system 200. Common reference numbers refer to common elements in FIGS. 2A-5.

The housing 210 has a first portion 210*a* and a second portion 210*b*. The first portion 210*a* has an inlet 212 for receiving combustion products and the second portion 210*b* has an outlet 211, proximate to the aperture 265, and positioned to propagate combustion between the second portion 210*b* of the housing 210 and the combustible material 262. The housing can be formed from any single or combination of materials, including metal, plastic, silicone, and/or a composite material. A combustible carrier material 220 is movable from the first portion 210*a* of the housing 210 to the second portion 210*b*. The combustible carrier material 220 can be ignited in the first portion 210*a* of the housing 210 and is capable of sustaining combustion while being moved from the first portion 210*a* of the housing 210 to the second portion 210*b* where combustion can propagate through the outlet 211 and the aperture 265 to the combustible material 262.

The launcher 202 includes a launch platform 207 that includes a platform portion 207*a* on which the deployable component 201 rests and piston portion 207*b*. The piston portion 207*b* is received in a recessed portion of the launcher 202. The launcher 202 also receives an expulsion charge 205 proximate to the piston portion 207*b*. The expulsion charge 205 can include any type of charge that releases an expanding gas and combustion products (e.g., an impulse charge that uses gun powder). When the expulsion charge 205 is detonated, the resulting expanding gases and combustion products (e.g., flames, hot gases, and sparks) will cause the launch platform 207 to propel the deployable component 201 out of the launcher 202. The launch platform 207 also includes a port 208 that allows a portion of the combustion products produced by the expulsion charge 205 to migrate through the piston portion 207*b*, the platform portion 207*a*, and into the first portion 210*a* of the housing 210. The combustion products can ignite the combustible carrier material 220 when the combustible carrier material 220 is in the first portion 210*a* of the housing 210.

A biasing mechanism 255 is positioned to urge the combustible carrier material 220 toward the second portion 210*b* of the housing 210. A device 250 movable between a first position and a second position is located proximate to the combustible carrier material 220 and the biasing mechanism 255. When the deployable component 201 is in the launcher 202, the device is held in the first position. In the first position, the device 250 restricts the biasing mechanism 255 from moving the combustible carrier material 220 from the first portion 210*a* of the housing 210 to the second portion 210*b*. The device 250 can move to the second position when the deployable component 201 leaves the launcher 202. When the device 250 is in the second position, it does not prevent the biasing mechanism 255 from moving the combustible carrier material 220 to the second portion 210*b* of the housing 210. For example, when the deployable component 201 is clear of the launcher 202, a single biasing mechanism 255 can simultaneously urge the combustible carrier material 220 to move to the second portion 210*b* of the housing 210 and the device 250 to move to the second position, as shown in the illustrated embodiment. In other embodiments, separate biasing devices 255 can be used to move the combustible carrier material 220 and the device 250.

FIG. 2B is a partially schematic cut-away view of the pyrotechnic system 200 shown in FIG. 2A where an expulsion charge 205 has been detonated and the expanding gases and combustion products indicated as arrows C have begun to deploy the deployable component 201. The expanding gases and combustion products are causing the launch platform 207 to push the deployable component 201 out of the launcher 202. Additionally, a portion of the high-temperature combustion products are migrating through the port 208 in the launch platform 207, through the inlet 212, and into the first portion 210*a* of the housing 210 igniting the combustible carrier material 220. Because the deployable component 201 is still in the launcher 202, the device 250 is held in the first position, preventing the combustible carrier material 220 from moving out of the first portion 210*a* of the housing 210. A seal 225 is positioned to block the migration of combustion products between the first and second portions 210*a* and 210*b* of the housing 210 when the combustible carrier material 220 is in the first portion of the housing 210. Accordingly, combustion products do not migrate from the first portion 210*a* of the housing, to the second portion 210*b*, so the seal 225 blocks the combustion products from migrating through the outlet 211 to the combustible material 262. The seal can be formed from any single or combination of suitable materials (e.g., a silicone material and/or a composite material).

Figure 2D:
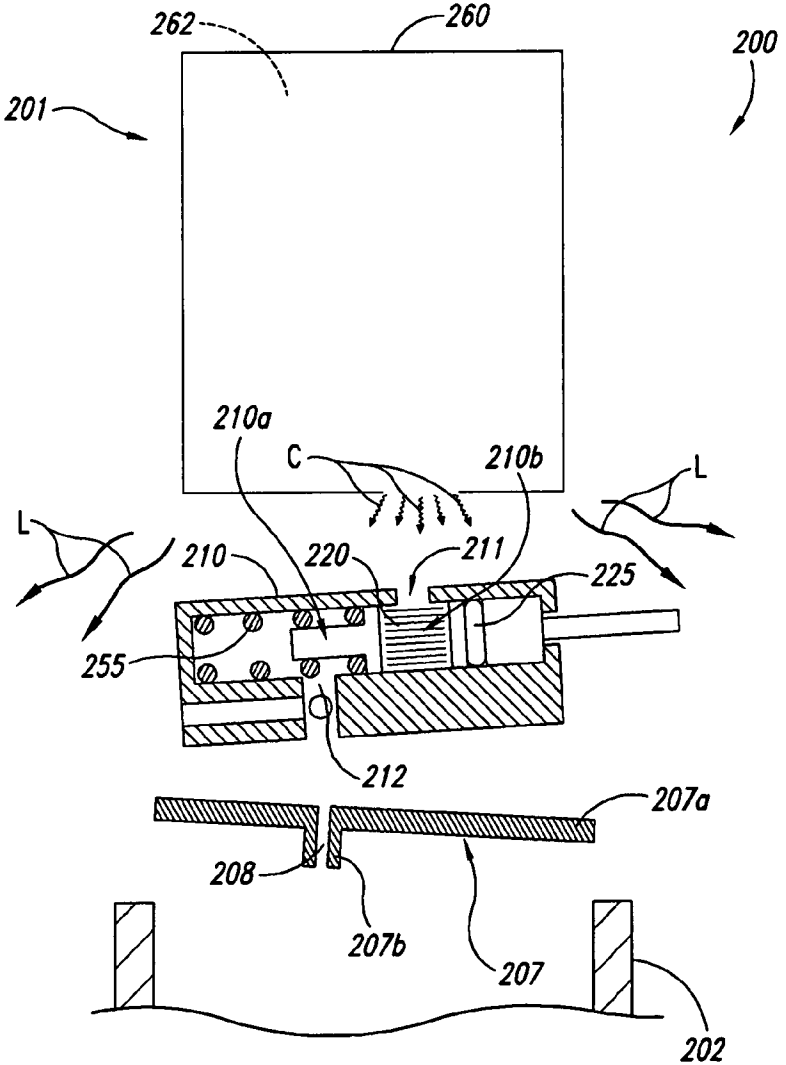
FIG. 2D is a partially schematic cut-away view of the pyrotechnic system shown in FIG. 2C, having a package with a combustible material that has been ignited.
Figure 2C:
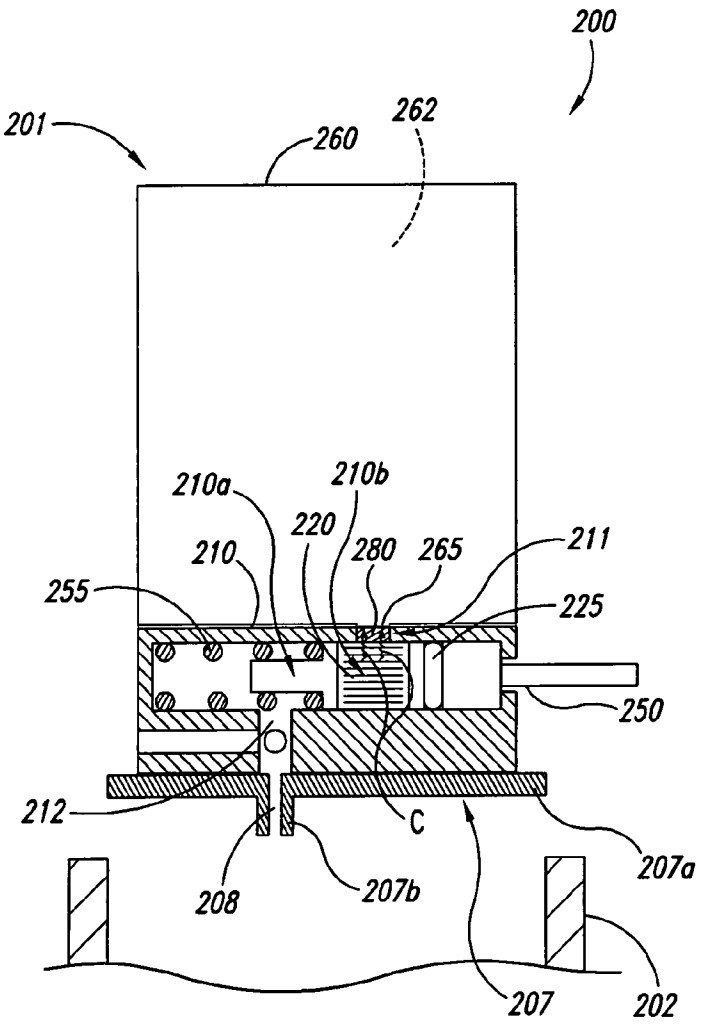
FIG. 2C is a partially schematic cut-away view of the pyrotechnic system shown in FIG. 2B where the deployable component has been deployed from the launcher.

FIG. 2C is a partially schematic cut-away view of the pyrotechnic system 200 shown in FIG. 2B where the deployable component 201 has been deployed from (e.g., cleared or exited) the launcher 202. As the deployable component 201 clears the launcher 202, the biasing device 255 moves the device 250 from the first position to the second position and slides the combustible carrier material 220 from the first portion 210*a* of the housing 210 to the second portion 210*b*. Once the combustible carrier material 220 has moved to the second portion 210*b* of the housing 210, combustion propagates (shown by arrows C) from the combustible carrier material 220 through the outlet 211 and the aperture 265 to the combustible material 262. The propagation of combustion can be aided by at least one combustible intermediary material 280 (e.g., a fuse) positioned proximate to (e.g., inside) the outlet 210 and the aperture 265 and/or between the combustible carrier material 220 and the combustible material 262, as shown in FIG. 2C. In other embodiments, combustion can propagate between the combustible carrier material 220 and the combustible material 262 without the aid of a combustible intermediary material 280.

FIG. 2D is a partially schematic cut-away view of the pyrotechnic system 200 shown in FIG. 2C, having a package 260 with a combustible material 262, that has been ignited (the resulting combustion being shown by arrows C). In certain embodiments, as the combustible material 262 begins to burn, the housing 210 separates from the combustible material 262 as shown in FIG. 2D. The combustible material 262 can perform various functions once ignited. For example, the combustible material 262 can be flare grain and once ignited can emit electromagnetic radiation (shown as arrows L). In other embodiments, the combustible material 262 can include other types of devices, for example, an expulsion device.

In still other embodiments, the combustible material 262 can simply be coupled to the housing without any additional packaging and/or without the aperture 265 described above. For example, in certain embodiments, the combustible material 262 can simply be placed on top of the housing 210 and the outlet 211 can be in communication with a portion of the combustible material 262. In other embodiments, the packaging surrounding the combustible material 262 can be flammable and/or a portion of the packaging can act as a combustible intermediary material 280. In still other embodiment, the package can contain multiple combustible materials 262.

A feature of foregoing embodiments discussed above with reference to FIGS. 2A-2D is that the seal 225 prevents the migration of combustion products from the first portion 210*a* of the housing 210 to the second portion 210*b* when the combustible carrier material 220 is in the first portion 210*a*. This prevents the ignition of the combustible material 262 until the deployable component 201 has cleared the launcher 202 and the device 250 allows the combustible carrier material 220 to move to the second portion 210*b*. An advantage of this feature is that the combustible material 262 does not prematurely ignite and burn until clear of the launcher 202, allowing the pyrotechnic system 200 to function more reliably and with better safety than conventional systems (e.g., conventional aircraft decoy flares). This feature can be especially important for decoy flares installed on commercial aircraft and other vehicles.

Figure 3:
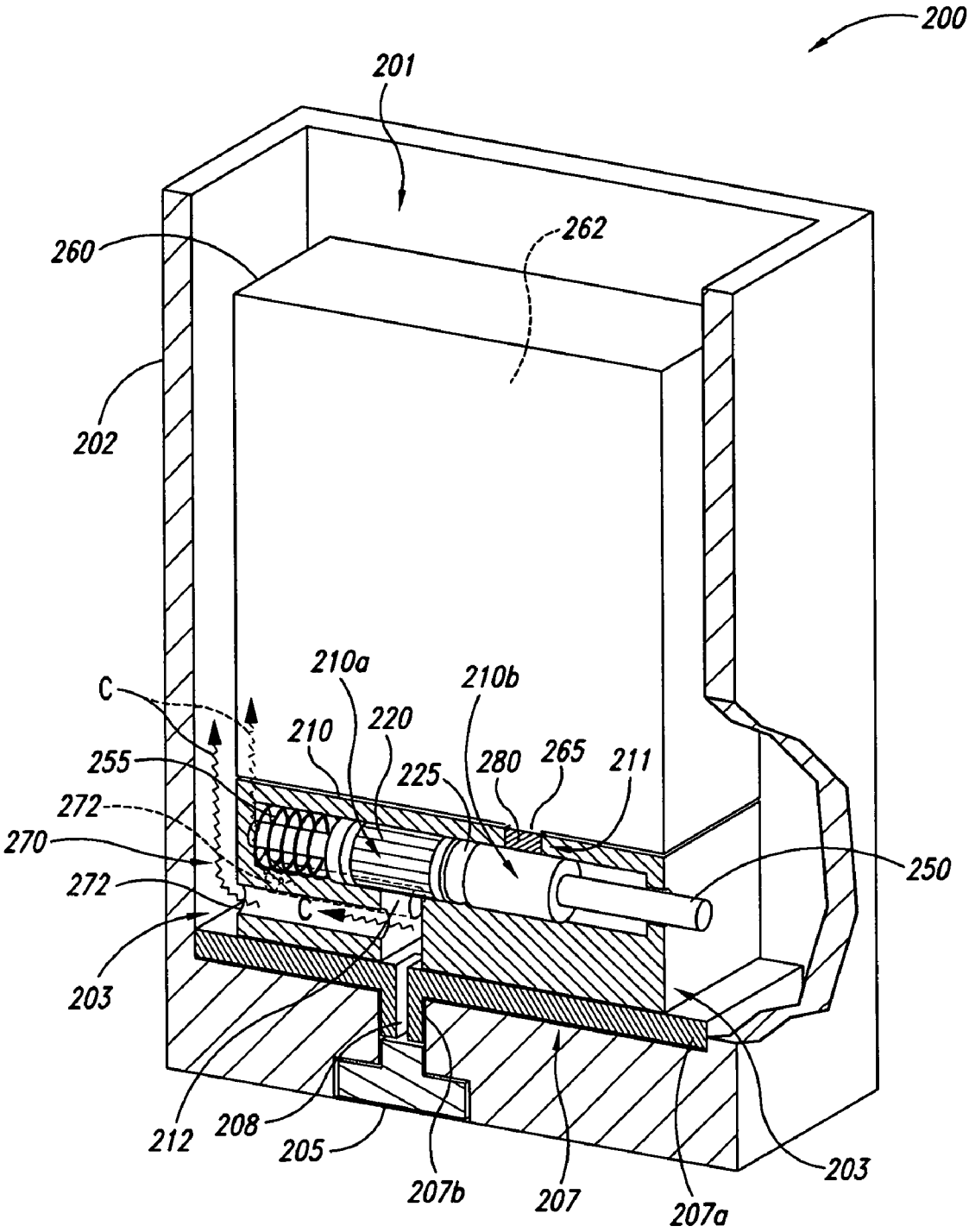
FIG. 3 is a partially schematic cutaway view of the pyrotechnic system shown in FIG. 2A illustrating a vent system.

FIG. 3 is a partially schematic cutaway view of the pyrotechnic system 200 shown in FIG. 2A illustrating a vent system 270 that carries combustible products away from at least a portion of the deployable component 201 in the unlikely event of a malfunction. For example, the combustible carrier material 220 and/or the expulsion charge 205 can be inadvertently ignited even though the deployable component 201 is jammed in the launcher 202 and/or not being deployed. If the combustion products produced by the burning combustible carrier material 220 and/or the expulsion charge 205 can be kept away from the combustible material 262, for example by the vent system 270, the combustible material can be prevented from being ignited. This in turn can prevent having the combustible material 262 (e.g., the flare grain in a flare) from burning while the deployable component 201 is still in the launcher.

In the illustrated embodiment, the vent system 270 is located proximate to the first portion 210*a* of the housing 210 and the inlet 212. The vent system 270 includes at least one passageway 272 to allow combustion products to migrate away from the first portion 210*a* of the housing 210 and/or the inlet 212. In FIG. 3, two passageways 272 are shown, however, as illustrated in FIGS. 2A and 4F the housing 210 includes two additional passageways 272 (not shown in the present illustration). The two additional passageways 272 are in the front and rear of the housing 210 proximate to where the port 208 in the launch platform 207 communicates with the first portion 210*a* of the housing 210. Other embodiments can have more or fewer passageways 272.

Additionally, in certain embodiments, the passageway(s) 272 can be configured (e.g., the number and size adjusted) so that it/they can accommodate a higher flow rate than the port 208 in the launch platform. The higher flow rate capability of the passageway(s) 272 can provide a capability to quickly vent combustion products during certain malfunctions, while the lower flow rate of the port 208 can prevent the expanding gases from the expulsion charge 205 from being vented to quickly during deployment, allowing the gases to apply sufficient pressure/force to the piston portion 207*b* of the launch platform 207 to provide suitable launch characteristics. Furthermore, if during a malfunction the combustible carrier material 220 is ignited and the expulsion charge 205 is not, the combustion products will be more likely to migrate through the passageway(s) 272 than through the port 208 to the expulsion charge 205, reducing the probability that the expulsion charge 205 will ignite. Other embodiments can have different configurations with different comparative flow rates.

The passageways 272 vent combustion products, shown as arrow C in FIG. 3, to a portion 203 of the launcher 202. For example, the passageways 272 can vent the combustion products into the launch tube in which the deployable component 201 is located. In certain embodiments wherein the launch tube of the launcher 202 may be sealed, however, the tube is large enough to accept a significant amount of combustion products without breaching the seal. In other embodiments, the combustion products can be vented from the portion 203 of launcher 202 and/or the passageways 272 can be coupled to passageways in the launcher 202, carrying the combustion products away from the deployable component 201 and the launcher 202.

Because the combustion products are carried away from the first portion 210*a* of the housing 210 and/or the inlet 212, the combustion products will not substantially migrate to the second portion 210*b* of the housing 210. Additionally, the seal 225, discussed above, can further aid in preventing combustion products from migrating between the first and second portions 210*a* and 210*b* of the housing 210 while the combustible carrier material 220 is in the first portion 210*a* of the housing 210. Accordingly, even if the combustion products are vented into a portion 203 of the launcher 202, ignition of the combustible material 262 can be prevented during certain malfunctions provided that other areas of the combustible material 262 are protected from the combustion products. For example, the combustible material 262 is sealed except for the aperture 265 that is proximate to the outlet 211 of the second portion 210*b* of the housing 210. When the combustion products are carried away from the launcher 202, the necessity to seal or protect the other areas of the combustible material 262 can be reduced.

A feature of embodiments discussed above with reference to FIG. 3 is that because the combustion products are carried away from the inlet 212 and the first portion 210*a* of the housing 210, the combustible material 262 can be prevented from prematurely igniting. This in turn can prevent the first combustible material 262 from burning in the launcher 202. An advantage to this feature is that safety can be increased because even during a malfunction the first combustible material 262 can remain unignited. This can be especially important for use on commercial airliners, other aircraft, and/or other vehicles where the deployable component 201 can be sealed in the launcher 202 (e.g., behind a door) until it is intentionally deployed.

As discussed above, in some cases it can be desirable to seal or protect the combustible material 262 from combustion products/sources other than those intended to be propagated from the second portion 210*b* of the housing 210. Accordingly, as shown in FIGS. 4A-4F, at least one gasket 230 can be positioned proximate to the outlet 211 of the housing 210 to prevent the migration of combustion products to the combustible material 262, except from the outlet 211. The gasket can be made of any single or combination of suitable materials (e.g., a silicone material and/or a composite material). FIGS. 4A-4F is a partially exploded schematic illustration of the deployable component 201, shown in FIG. 2A, during different stages of assembly. For the purpose of illustration, many of the elements shown in FIGS. 4A-4F were not shown in FIGS. 2A-3, however, like reference numbers refer to like elements in FIGS. 2A-4F.

Figure 4A:
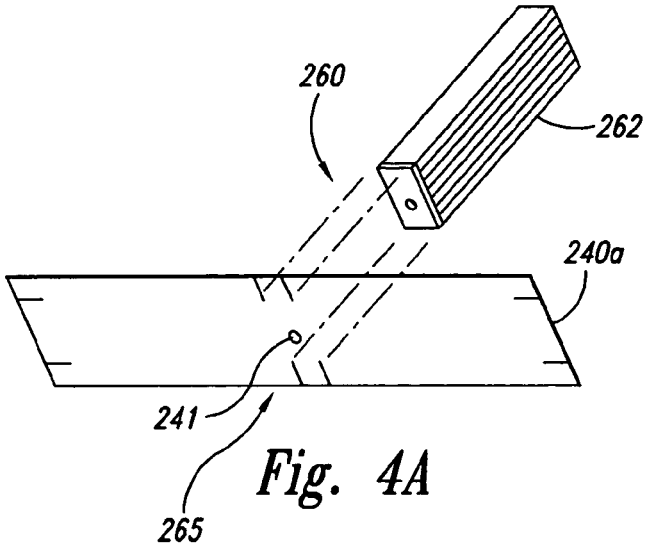
FIG. 4A is a partially exploded schematic illustration of the combustible material of the pyrotechnic system shown in FIG. 2A prior to tape being applied to the combustible material.
Figure 4B:
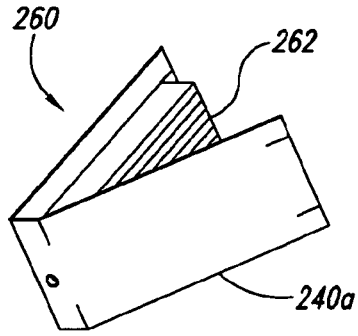
FIG. 4B is a partially exploded schematic illustration of the combustible material of the pyrotechnic system shown in FIG. 4A, with the tape partially applied.
Figure 4C:
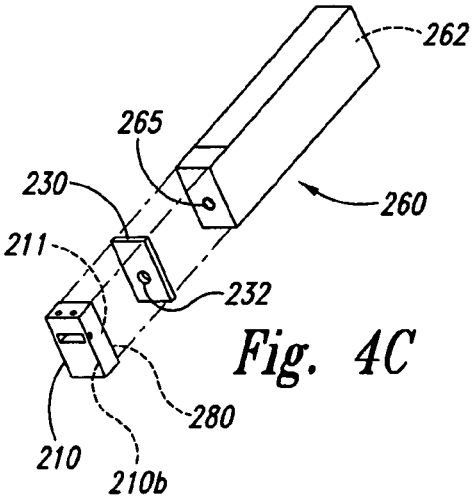
FIG. 4C is a partially exploded schematic illustration of the package shown in FIGS. 4A and 4B with a gasket and a housing positioned to be coupled to the package to form a portion of the deployable component.

FIGS. 4A-4B illustrate a first portion of tape 240*a* (e.g., laminated aluminum-fiber tape) being used to completely surrounds the first combustible material 262, to produce the package 260 shown in FIG. 2A. Once the tape 240*a* has been applied, only a portion of the combustible material 262 remains exposed by the aperture 241 in the first portion of the tape 240*a*. The aperture 241 in the first portion of the tape 240*a* thereby forms at least a portion of the aperture 265, which is proximate to the combustible material 262, in the package 260 (discussed above with reference to FIG. 2A). In FIG. 4C, a gasket 230 with a gasket aperture 232 is positioned proximate to the aperture 265 of the package 260. The housing 210 is positioned so that the outlet 211 of the second portion 210*b* of the housing 210 is proximate to the aperture 265 and the gasket aperture 232, so that combustion can propagate from the second portion of the housing 210 to the combustible material 262. As discussed above with reference to FIGS. 2A-2D, in certain embodiments at least one combustible intermediary material can be positioned proximate to the second portion 210*b*, the outlet 211, the gasket aperture 232, the aperture 265, and/or the combustible material 262.

Figure 4D:
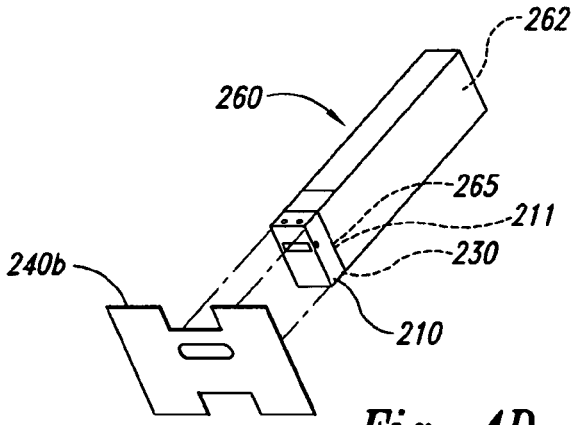
FIG. 4D is a partially exploded schematic illustration of the package, the gasket, and the housing shown in FIG. 4C being coupled together by the application of a second portion of tape.
Figure 4E:
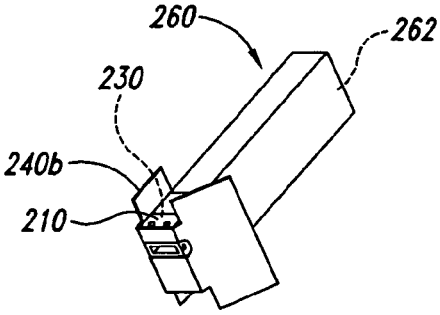
FIG. 4E is a partially exploded schematic illustration of the package, gasket, and housing, and second portion of tape shown in FIG. 4D, at another point during the process of applying the second portion of tape.
Figure 4F:
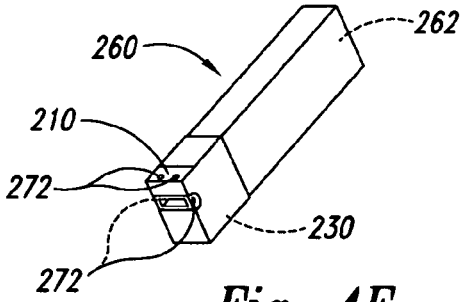
FIG. 4F is a partially exploded schematic illustration of the package, gasket, and housing shown in FIG. 4E, coupled together by the second portion of tape.

FIGS. 4D-4F illustrate a second portion of tape 240*b* being applied to surround a portion of the housing 210, a portion of the at least one gasket 230, and a portion of the package 260, securing the gasket 230 in place. The gasket 230, when secured in place, can prevent combustion products from migrating to the combustible material 262, except through the outlet 211 of the housing 210. The second portion of tape 240*b* can also aid in preventing the migration of combustion products through the aperture 265, except from the outlet 211. Additionally, as shown in the illustrated embodiment, the second portion of tape 240*b* can couple the housing 210 to the package 260 and to the first combustible material 262, and can serve to apply a compressive force to the gasket 230 making the gasket 230 seal more effective.

In other embodiments, multiple gaskets can be located proximate to the outlet 211 of the housing 210 and/or the combustible material 262. For example, a gasket with a gasket aperture can also be positioned between the combustible material 262 and the first portion of tape 240*a*. In other embodiments, the housing 210 can be coupled to the package 260 and/or the first combustible material 262 in other ways (e.g., an outer housing that holds both the housing 210 and the first combustible material 262). Additionally, in other embodiments, the at least one gasket 230 can be used without any tape (e.g., a strap can secure the package 260 to the housing 210 with the gasket 230 between the two). In still other embodiments, different types of gaskets or seals can be used. For example, a liquid gasket material can be applied proximate to the intersection of the housing 210 and the combustible material 262 to prevent the migration of combustion products to the combustible material 262, except from the outlet 211 of the housing 210. Additionally, the liquid gasket material can serve to couple the housing 210 to the package 260 (e.g., acting as a cement or adhesive when the liquid gasket material cures and/or hardens).

A feature of embodiments discussed above with reference to FIGS. 4A-4F is that the migration of combustible products to the first combustible material 262 can be prevented, except from the outlet 211 of the housing 210. An advantage of this feature is that premature ignition of the first combustible material 262 (e.g., during deployment of the deployable component 201) and/or ignition of the first combustible material 262 can be prevented. This can make the carriage and operation of the pyrotechnic device more reliable and safer. Additionally, this feature can be particularly important in preventing the inadvertent ignition of the combustible material 262 when the vent system, discussed above with reference to FIG. 3, vents combustion products into a portion of the launcher during certain malfunctions.

Figure 5:
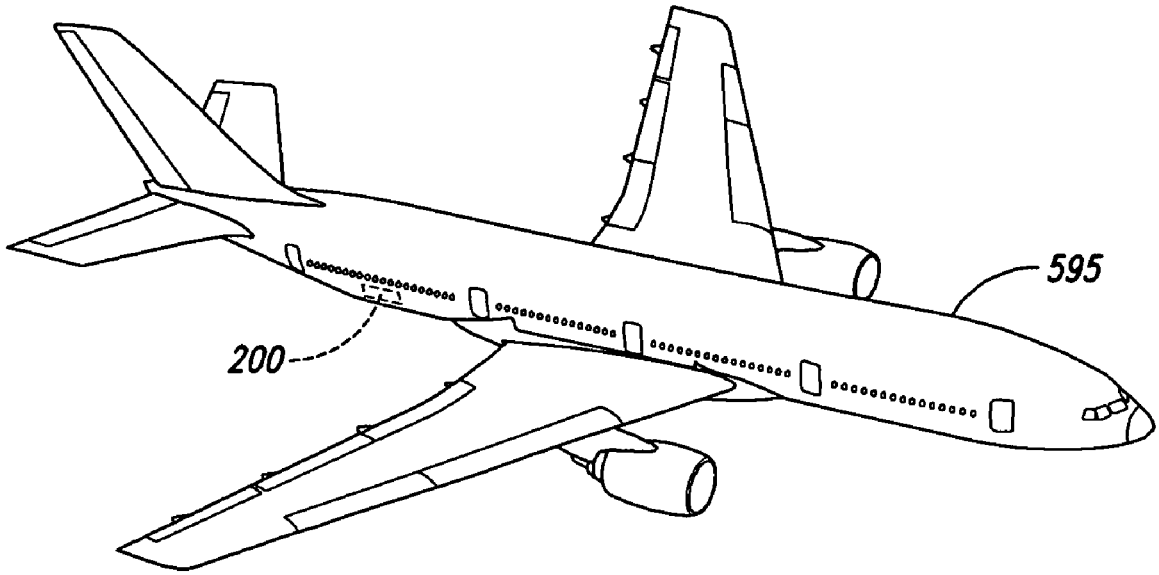
FIG. 5 is a schematic illustration of a vehicle including a pyrotechnic system in accordance with embodiments of the invention.

Embodiments discussed above with reference to FIGS. 2A-4F can be particularly suited for operations near or on a vehicle. FIG. 5 is a partially schematic illustration of a vehicle 595 (e.g., an aircraft) having a pyrotechnic system 200 in accordance with embodiments of the invention. Additionally, many of the features discussed above can be used singularly or in combination to tailor the pyrotechnic system 200 for a particular use. For example, several of the features discussed above can be suitable for a pyrotechnic system 200 used on commercial aircraft, for example, a pyrotechnic system configured as a flare on a commercial airliner.

From the foregoing, it will be appreciated that specific embodiments of the invention have been described herein for purposes of illustration, but that various modifications may be made without deviating from the spirit and scope of the invention. For example, features described in the context of particular embodiments can be combined or eliminated in other embodiments. Accordingly, the invention is not limited except as by the appended claims.

We claim:

1. A flare deployable from a launcher, the flare comprising:

a flare grain configured to produce an electromagnetic radiation emission during combustion;

a housing having a first portion and a second portion, the first portion having an inlet for receiving combustion products, the second portion having an outlet, the outlet being positioned to propagate combustion between the second portion of the housing and the flare grain;

a combustible carrier material movable from the first portion of the housing to the second portion of the housing, the combustible carrier material being ignitable in the first portion of the housing and capable of sustaining combustion while being moved to the second portion of the housing;

a seal positioned to block a migration of combustion products between the first and second portions of the housing when the combustible carrier material is in the first portion of the housing;

a biasing mechanism urging the combustible carrier material toward the second portion of the housing; and a device movable between a first position and a second position, the device in the first position restricting the biasing mechanism from moving the combustible carrier material to the second portion of the housing and the device in the second position allowing the biasing mechanism to move the combustible carrier material to the second portion of the housing, and a package containing the flare grain, the package includes a first portion of tape surrounding the flare grain, the first portion of tape including the aperture to communicate with the outlet of the housing, and wherein the system further comprises a second portion of tape surrounding a portion of the housing, a portion of the seal, and a portion of the package, the second portion of tape being positioned to prevent the migration of combustion products through the aperture except from the outlet.

2. The system of claim 1 wherein the inlet is positioned to receive combustion products released from an expulsion charge.

3. The system of claim 1 wherein the seal includes a silicone material.

4. The system of claim 1 wherein at least a portion of the device includes a silicone material.

5. The system of claim 1, further comprising at least one flammable material positioned to propagate combustion between the second portion of the housing and the flare grain.

6. The system of claim 1 wherein the flare is carried by a vehicle.

7. A pyrotechnic system, comprising:

a package having a combustible material, the package having an aperture proximate to the combustible material;

a housing having a first portion and a second portion, the first portion having an inlet for receiving combustion products, the second portion having an outlet in communication with the aperture to propagate combustion between the second portion of the housing and the combustible material in the package;

a combustible carrier material movable from the first portion of the housing to the second portion of the housing, the combustible carrier material being ignitable in the first portion of the housing and capable of sustaining combustion while being moved to the second portion of the housing; and at least one gasket positioned proximate to the outlet and the aperture to prevent the migration of combustion products through the aperture except from the outlet, wherein the combustible material includes flare grain and the package includes a first portion of tape surrounding the flare grain, the first portion of tape including the aperture to communicate with the outlet of the housing, and wherein the system further comprises a second portion of tape surrounding a portion of the housing, a portion of the at least one gasket, and a portion of the package, the second portion of tape being positioned to prevent the migration of combustion products through the aperture except from the outlet.

8. The system of claim 7 wherein the inlet is positioned to receive combustion products released from an expulsion charge.

9. The system of claim 7 wherein the at least one gasket includes a silicone material.

10. The system of claim 7, further comprising at least one portion of tape positioned proximate to the at least one gasket to prevent the migration of combustion products through the aperture except from the outlet.

11. The system of claim 7, further comprising a seal positioned to block a migration of combustion products between the first and second portions of the housing when the combustible carrier material is in the first portion of the housing.

12. The system of claim 7 wherein the combustible material in the package includes a first combustible material, and the system further comprises at least one combustible intermediary material positioned between the second portion of the housing and the first combustible material.

13. The system of claim 7, further comprising:

a biasing mechanism urging the combustible carrier material toward the second portion of the housing; and a device movable between a first position and a second position, the device in the first position restricting the biasing mechanism from moving the combustible carrier material to the second portion of the housing and the device in the second position allowing the biasing mechanism to move the combustible carrier material to the second portion of the housing.

14. The system of claim 7 wherein the pyrotechnic system includes a flare.

15. The system of claim 7 wherein the pyrotechnic system is carried by a vehicle.

16. A pyrotechnic system, comprising:

a combustible material that includes flare grain;

a housing having a first portion and a second portion, the first portion having an inlet for receiving combustion products, the second portion having an outlet, the outlet being positioned to propagate combustion between the second portion of the housing and the combustible material;

a combustible carrier material movable from the first portion of the housing to the second portion of the housing, the combustible carrier material being ignitable in the first portion of the housing and capable of sustaining combustion while being moved to the second portion of the housing;

a vent system being located proximate to the first portion of the housing and the inlet, wherein the vent system includes a passageway to allow combustion products to migrate away from at least one of the first portion of the housing and the inlet;

a gasket;

a first portion of tape surrounding the flare grain, the first portion of tape including the aperture to communicate with the outlet of the housing; and a second portion of tape surrounding a portion of the housing and a portion of the gasket, the second portion of tape being positioned to prevent the migration of combustion products through the aperture except from the outlet.

17. The system of claim 16 wherein the inlet is positioned to receive combustion products released from an expulsion charge.

18. The system of claim 16 wherein the system further comprises a launcher to deploy the pyrotechnic device, the launcher having a portion that receives the combustion products that migrate through the vent system.

19. The system of claim 16, further comprising a seal positioned to block a migration of combustion products between the first and second portions of the housing when the combustible carrier material is in the first portion of the housing.

20. The system of claim 16 wherein the combustible material is contained in a package having an aperture proximate to the combustible material, and wherein the system further comprises at least one gasket positioned proximate to the outlet and the aperture to prevent the migration of combustion products through the aperture except from the outlet.

21. The system of claim 16, further comprising:

a biasing mechanism urging the combustible carrier material toward the second portion of the housing; and a device movable between a first position and a second position, the device in the first position restricting the biasing mechanism from moving the combustible carrier material to the second portion of the housing and the device in the second position allowing the biasing mechanism to move the combustible carrier material to the second portion of the housing.

22. The system of claim 16 wherein the combustible material includes a first combustible material, and the system further comprises at least one combustible intermediary material positioned between the second portion of the housing and the first combustible material.

23. The system of claim 16 wherein the pyrotechnic system includes a flare.

24. The system of claim 16 wherein the pyrotechnic system is carried by a vehicle.

25. A method for making a pyrotechnic system, comprising:

providing a package having a combustible material, the package having an aperture proximate to the combustible material;

coupling a housing to the package, the housing having a first portion and a second portion, the first portion having an inlet for receiving combustion products, the second portion having an outlet, the outlet in communication with the aperture to propagate combustion between the second portion of the housing and the combustible material in the package;

installing a combustible carrier material movable from the first portion of the housing to the second portion of the housing, the combustible carrier material being ignitable in the first portion of the housing and capable of sustaining combustion while being moved to the second portion of the housing; and positioning at least one gasket proximate to the outlet and the aperture to prevent the migration of combustion products through the aperture except from the outlet, wherein providing a package having a combustible material includes providing a package having flare grain and a first portion of tape surrounding the flare grain, the first portion of tape including an aperture to communicate with the outlet of the housing, and wherein the method further comprises surrounding a portion of the housing, a portion of the at least one gasket, and a second portion of the package with a second portion of tape, the second portion of tape being positioned to prevent the migration of combustion products through the aperture except from the outlet.

26. The method of claim 25, further comprising positioning a seal to block a migration of combustion products between the first and second portions of the housing when the combustible carrier material is in the first portion of the housing.

27. The method of claim 25, further comprising positioning at least one portion of tape proximate to the at least one gasket to prevent the migration of combustion products through the aperture except from the outlet.

28. The method of claim 25, further comprising:

positioning a biasing mechanism to urge the combustible carrier material toward the second portion of the housing; and operatively coupling a device movable between a first position and a second position to the biasing mechanism, the device in the first position restricting the biasing mechanism from moving the combustible carrier material to the second portion of the housing and the device in the second position allowing the biasing mechanism to move the combustible carrier material to the second portion of the housing.

29. The system of claim 25 wherein:

providing a package having a combustible material includes providing a package having a first combustible material; and coupling a housing to the package includes coupling a housing to the package with at least one combustible intermediary material positioned between the second portion of the housing and the first combustible material.

30. The method of claim 25 wherein providing a package having a combustible material includes providing a package having flare grain.

31. The method of claim 25, further comprising configuring the pyrotechnic system to be installed on a vehicle.

32. The method of claim 25, further comprising installing the pyrotechnic system on a vehicle.

* * * * *